United States Patent [19]

Zamotin

[11] Patent Number: 4,669,943

[45] Date of Patent: Jun. 2, 1987

[54] WHEELCHAIR FOR TRANSFERRING OCCUPANT TO MOTOR VEHICLE

[76] Inventor: Rodvinon I. Zamotin, 259 Nahkoda Dr., Miami Springs, Fla. 33166

[21] Appl. No.: 782,533

[22] Filed: Oct. 1, 1985

[51] Int. Cl.[4] ..... A61G 5/00

[52] U.S. Cl. ..... 414/343; 414/391; 414/399; 414/921; 414/347; 414/633; 414/590; 414/672; 414/786; 414/785; 212/175; 212/254; 280/289 WC; 280/242 WC; 254/7 R; 254/98; 254/100

[58] Field of Search ..... 414/921, 390, 343, 347, 414/391, 392, 629, 633, 399, 663, 665, 786, 666, 785, 668, 669, 672, 589, 590, 462, 543, 542; 212/175, 176, 179, 180, 247, 245, 246, 254; 254/7 R, 98, 100; 280/289 WC, 242 WC

[56] References Cited

U.S. PATENT DOCUMENTS

| | | | |
|---|---|---|---|
| 854,961 | 5/1907 | McCarthy | 414/633 |
| 1,407,855 | 2/1922 | Green | 212/180 |
| 3,643,825 | 2/1972 | Zane, Jr. | 414/633 X |
| 3,981,484 | 9/1976 | James | 414/921 X |
| 4,075,719 | 2/1978 | Sullivan | 414/543 X |
| 4,133,437 | 1/1979 | Gates | 414/921 X |
| 4,354,791 | 10/1982 | Antonellis | 414/921 X |
| 4,365,924 | 12/1982 | Brigman et al. | 414/921 X |
| 4,555,121 | 11/1985 | Lockard et al. | 414/921 X |
| 4,564,086 | 1/1986 | Kingston | 414/921 X |

FOREIGN PATENT DOCUMENTS

| | | | |
|---|---|---|---|
| 2456001 | 1/1981 | France | 414/921 |
| 2483222 | 12/1981 | France | 414/921 |
| WO82/01313 | 4/1982 | PCT Int'l Appl. . | |
| 609717 | 6/1978 | Switzerland | 212/176 |
| 1421368 | 1/1976 | United Kingdom . | |
| 2017014 | 10/1978 | United Kingdom . | |
| 2069969 | 9/1981 | United Kingdom | 414/921 |
| 2124560 | 2/1984 | United Kingdom . | |

*Primary Examiner*—Frank E. Werner

*Attorney, Agent, or Firm*—Larson and Taylor

[57] ABSTRACT

A wheel chair is provided which is adapted to permit the chair to be separated from the wheeled chassis so that the chair may be positioned on a seat of an automobile. The wheeled chassis provides support for the chair on the side of the chair so that the chair may be brought into the automobile through the open door with the wheeled chassis moving beneath the automobile. The support for the chair is rotatably on the wheeled chassis so that the chair can be rotated into alignment with the seat in the automobile. The support for the chair is also vertically adjustable so that the chair may be lowered to rest on the automobile seat. The wheeled chassis and support for the chair may then be disassembled and stored in the automobile.

6 Claims, 8 Drawing Figures

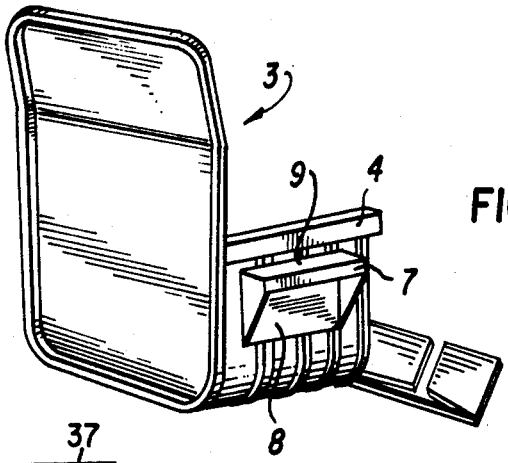
FIG. 1C
FIG. 1B
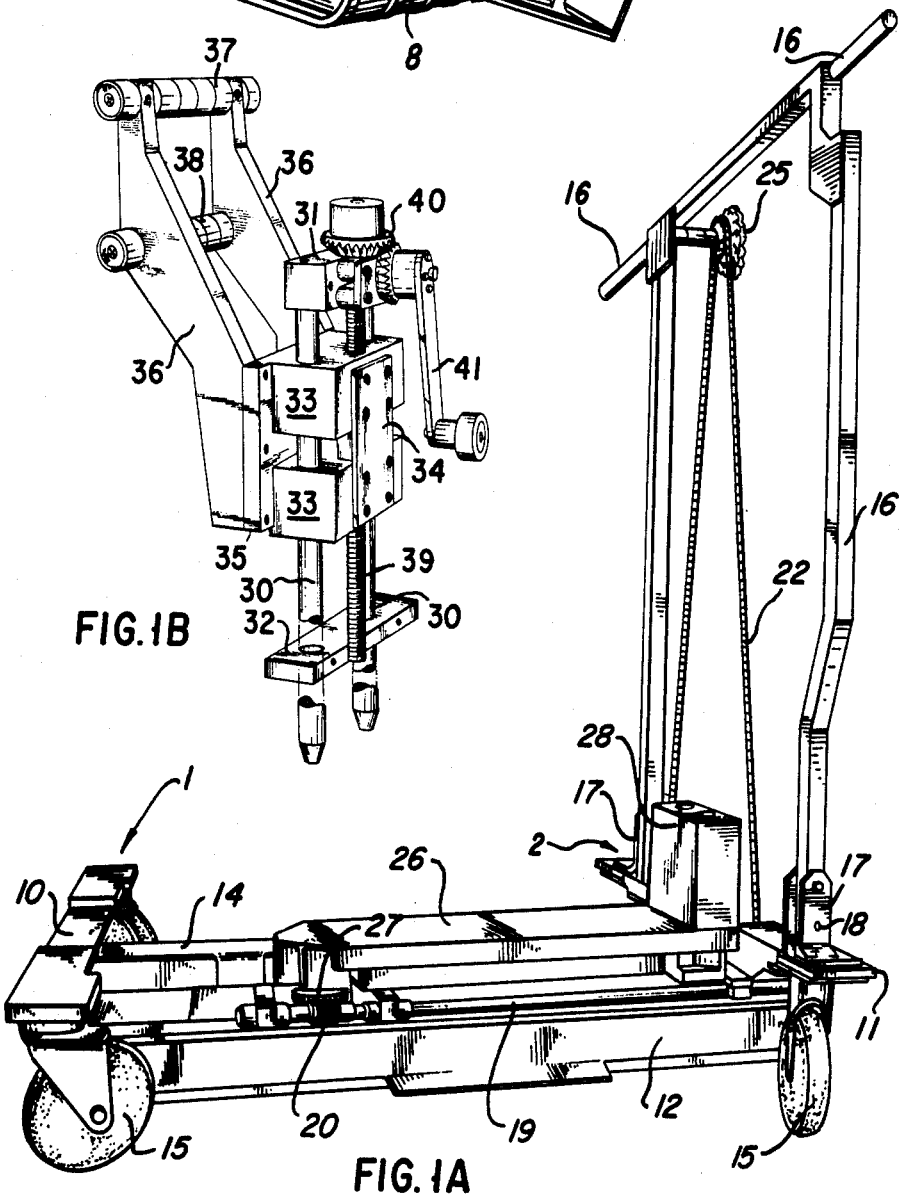
FIG. 1A

WHEELCHAIR FOR TRANSFERRING OCCUPANT TO MOTOR VEHICLE

BACKGROUND OF THE INVENTION

The present invention relates to a wheelchair and more specifically to a wheelchair which permits the chair to be separated from the wheeled chassis and supported on an automobile seat.

Heretofore there have been provided many mechanisms for transferring handicapped persons into an automobile. Prior art devices include slings which are supported from hanging arms and which may position a person over a car seat and lower the person onto the seat. Because of the limited area provided for entrance into a car it is exceedingly difficult to manoeuver a person into a car with such devices. Furthermore, of course, there is the additional difficulty in placing a patient in such a sling and removing the sling after transport.

There have been developed wheelchairs which permit the transfer of a person from a wheeled supporting frame into a vehicle or for bringing the entire wheelchair into the vehicle. U.S. Pat. Nos. 4,278,387; 4,170,368; 4,365,924; 4,354,791; 3,515,294; 3,865,427 and 4,483,653 are typical wheelchair designs of this type. All of these prior art devices require some modification of the structure of the automobile. These modifications include complete removal of the car seat, insertion of rotatable support arms within the car or insertion of trackways in the car seat. The device of the present invention requires no modification whatsoever of an automobile so that a person utilizing a wheelchair manufactured in accordance with the present disclosure may be transferred into any automobile quickly and easily without in any way altering the structure of the car.

SUMMARY OF THE INVENTION

The present invention comprises a device for transferring a person from a chair supported on a wheeled chassis into an automobile. The side of the chair is mounted on a vertical post extending from the chassis so that the chassis can be slid beneath a car while the supported chair can be moved through the open doorway of the car to a position over the seat of the car. The chair can then be rotated into alignment with the seat of the car and lowered to rest on the car seat. The wheeled chassis and chair supporting frame can be disengaged from the chair and disassembled for storage within the car.

An object of the present invention is to provide a wheelchair for handicapped persons in which the chair may be positioned on the seat of an automobile while attached to the wheeled chassis of the wheelchair and in which the chair can be subsequently disconnected from the wheeled chassis.

A further object of the present invention is to provide a wheelchair havng a supporting structure whch may be readily disassembled and stored when the chair is being used by a person being transported in an automobile. There are two advantages which result from the ease of disassembly of the wheelchair. The chair may be easily stored in a car trunk and furthermore by being able to separate the chassis from the chair frame the separate parts are lighter to lift.

Still another object of the present invention is to provide a wheelchair in which the chair is supported from a wheeled chassis by a vertical post disposed on the side of the chair and in which the chair may be rotated and moved vertically with respect to the wheeled chassis.

Other objects and many of the attendant advantages of the present invention will become more readily apparent upon consideration of the following detailed description in connection with the accompanying drawings wherein:

BRIEF DESCRIPTION OF THE DRAWINGS

FIGS. 1A, 1B and 1C show respectively the three separate sections of the wheelchair;

DETAILED DESCRIPTION OF THE DISCLOSED EMBODIMENT

Referring now more specifically to the drawings wherein like numerals indicate like parts throughout the several views there is shown a wheelchair which is formed of three separable parts, a chassis 1, chair supporting frame 2, and chair 3. Figure 1A shows the three separate sections which make up the wheelchair.

Figure 1:
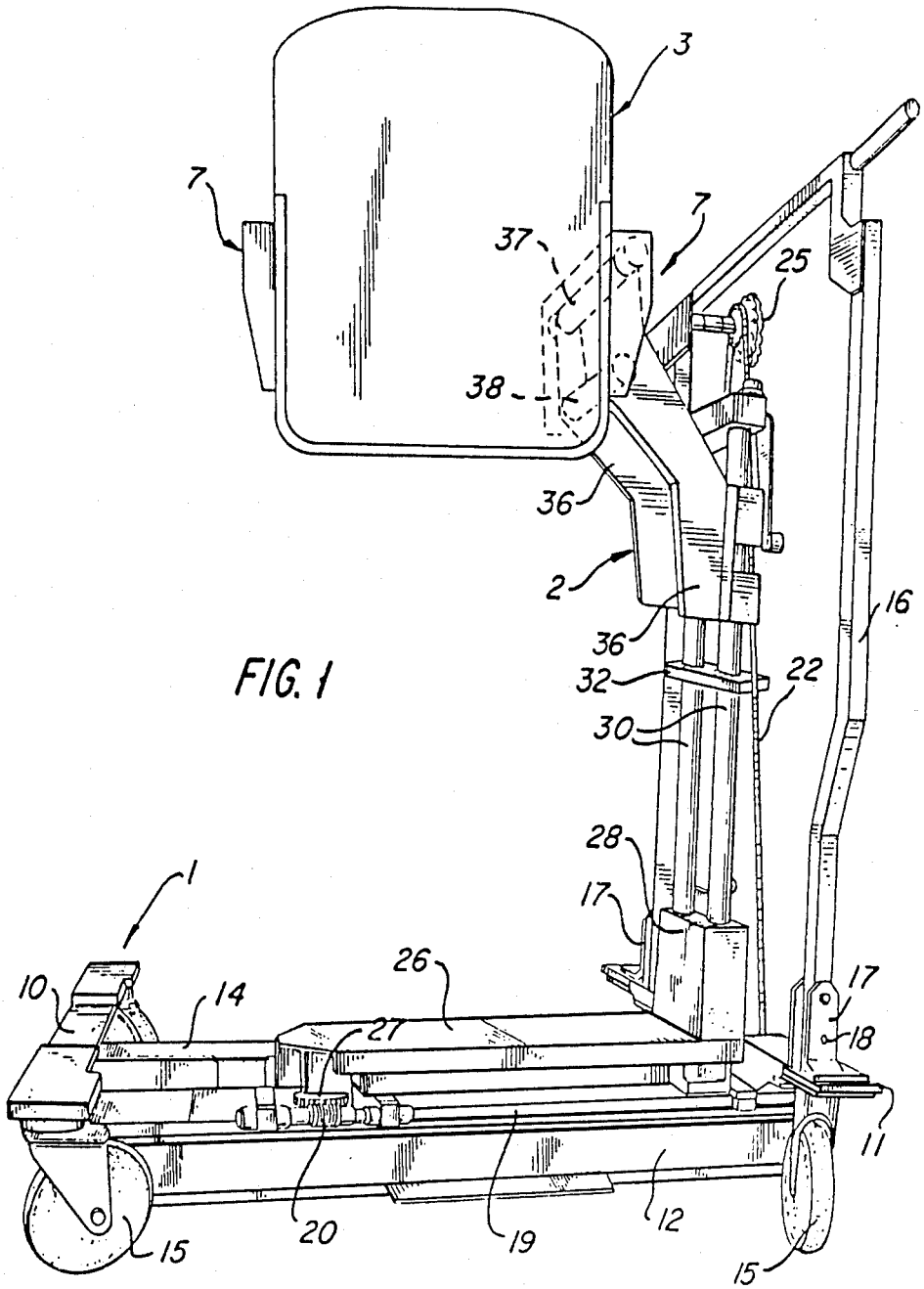
FIG. 1 is a perspective view in side elevation showing the chassis and chair supporting frame with the chair in phantom lines.
Figure 5:
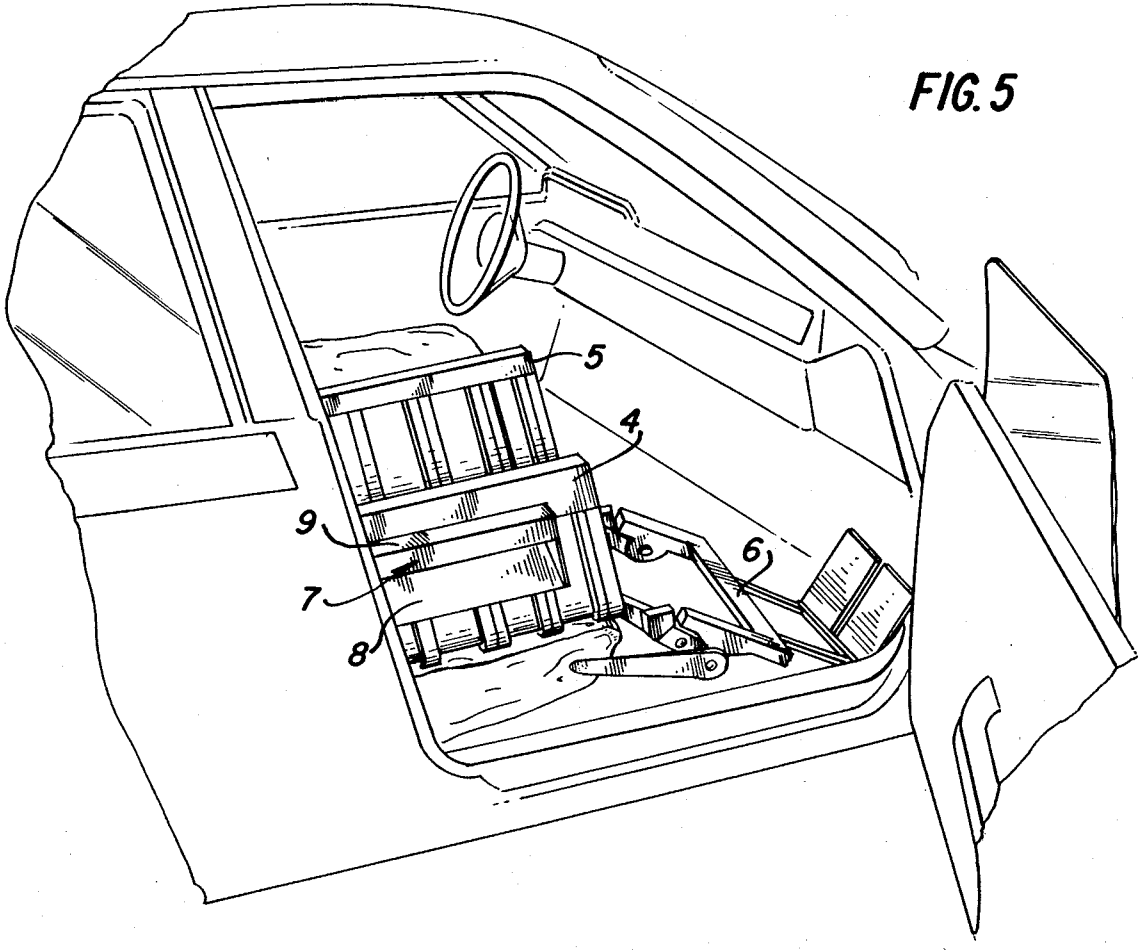
FIG. 5 is a perspective view showing the chair removed from the wheeled chassis and resting on the seat of an automobile.

The chair 3 may be formed of a lightweight metal such as aluminum and is provided with armrests 4 and 5 and an adjustable footrest 6 (FIGS. 5 and 1A). On the outside face of the armrest 4 there is affixed support means 7 including a rear plate 8 and a rectangular shaped housing 9 having side walls, end walls and a top wall with an open bottom so as to provide a rectangular shaped recess therein to receive the support bar 37 (FIGS. 1 and 3) of the chair supporting frame 2 as will be described more fully hereinafter.

The chassis 1 (FIG. 1A) comprises a frame or supporting platform having a pair of end plates 10 and 11 and cross bars 12, 13 and 14 affixed thereto to form a rigid structure. Casters 15 are mounted on each end of end plates 10 and 11 so as to swivel freely. A U-shaped handle 16 is provided for the chassis and the handle is pivotally mounted in brackets 17 fixed to end plate 11 as seen in FIG. 1. The pivotal mounting of handle 16 permits the handle to be swung to a position where it is on a plane substantially parallel to the supporting platform of the chassis 1. Any suitable locking means such as a removable pin 18 (FIG. 1) may be provided for securing the handle in its operative position extending vertically with respect to the supporting platform.

Figure 2:
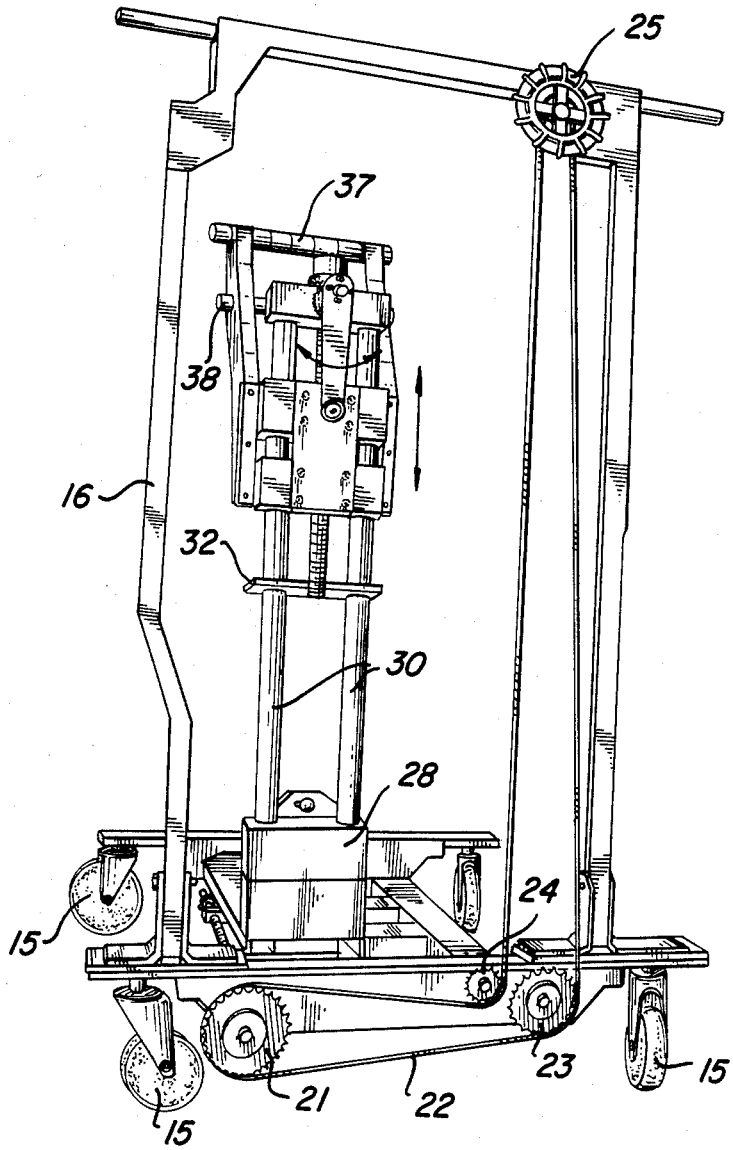
FIG. 2 is an end perspective view showing the chassis and chair supporting frame.

There is provided in the supporting platform of the chassis 1 means for rotatably mounting the supporting frame 2 on the chassis. A shaft 19 is mounted for rotation within or upon the cross bar 12 of the supporting platform as shown in FIG. 1. A screw thread 20 is provided on one end of the shaft 19 and the opposite end of the shaft 19 has a gear 21 (FIGS. 2 and 4) affixed thereto. A chain drive 22 extends around gear 21, engages gears 23 and 24 mounted on the chassis and passes upwardly to a gear and operating wheel 25 rotatably mounted on handle 16. The chain drive may be of any suitable flexible type such as, for example, the nylon and cable Maxiflex timing chain manufactured by Winfred M. Berg. It can be seen that by rotation of the operating wheel 25 the chain drives gear 21 to rotate shaft 19 and screw 20.

The supporting frame 2 (FIG. 3) attaches to a generally horizontally extending base member or arm 26 on the lower face of which extends a shaft having a worm gear 27 fixed thereon. The shaft on which worm gear 27 is mounted extends vertically below the gear and is journalled in a bearing mounted in the supporting platform of chassis 1. As shown in FIGS. 1 and 1A in the operative position worm gear 27 engages screw 20 so that rotation of screw 20 causes rotation of worm gear 27 and arm 26.

The outer end of arm 26 has a block 28 permanently mounted thereon by means of welds or bolts. The block has a pair of spaced holes therein to receive a pair of vertically extending tubular rods 30. The tubular rods provide a mounting for the chair supporting mechanism. Block 28 is fixed to base 26 and the tubular rods are removably supported in the bores in block 28 and have tapered ends for easy insertion.

Figure 3:
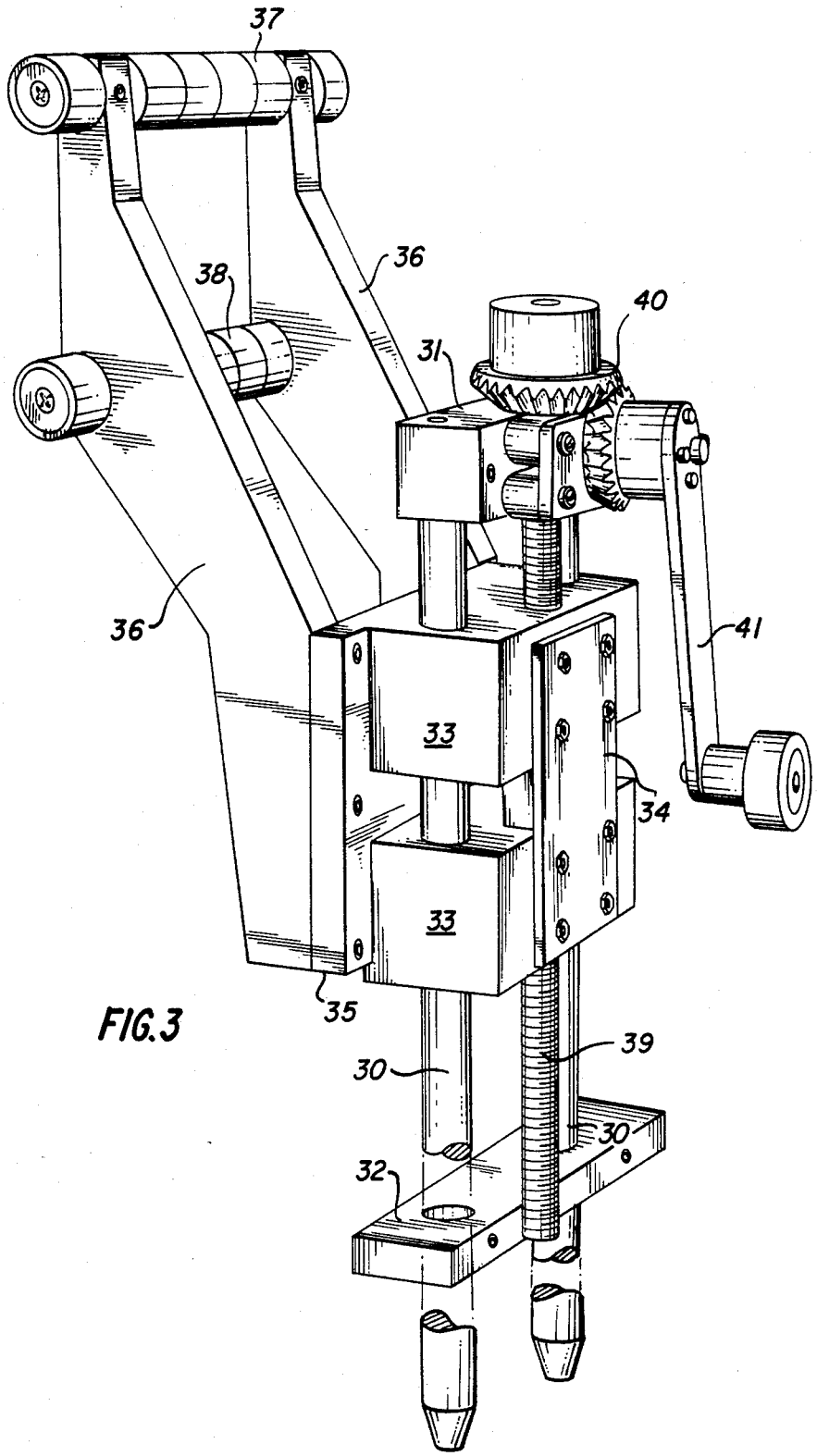
FIG. 3 is a perspective view of the mounting means for the chair.

As more clearly shown in FIG. 3 the upper end of tubular rods 30 are received in bores in an end block 31. There is also provided a stop block 32 which has bores therethrough to receive tubular rods 30 and provide a fixed stop for lowering of the chair 3 as will be explained more fully hereinafter.

The chair supporting frame (FIG. 3) includes upper and lower support blocks 33 which are slidable on tubular rods 30. Face plates 34 and 35 are secured to the outer faces of support blocks 33 to maintain the support blocks in precise alignment. Secured to face plate 35 are a pair of outwardly and upwardly extending arms 36 and support bars 37 and 38 are secured in spaced vertical relation to the outer ends of arms 36. The support bars 37 and 38 support the chair 3 as shown in FIG. 1. The upper support bar 37 fits within the recess formed inside housing 9 of support means 7 secured to the side of chair 3. The lower support bar 38 abuts the plate 8 of support means 7.

The means for raising and lowering the chair 3 is clearly shown in FIG. 3. Rotatably mounted within the end block 31 is a vertically disposed screw 39 having a bevel gear 40 fixed to the upper end thereof. A crank arm 41 having a bevel gear fixed thereto is journalled in end block 31. The upper and lower support blocks 33 have apertures therein to receive the screw 39. Nuts are fixed within the support blocks 33 so that rotation of the screw 39 will raise or lower the support blocks 33 between the end block 31 and the stop block 32.

OPERATION OF THE WHEELCHAIR

Figure 4:
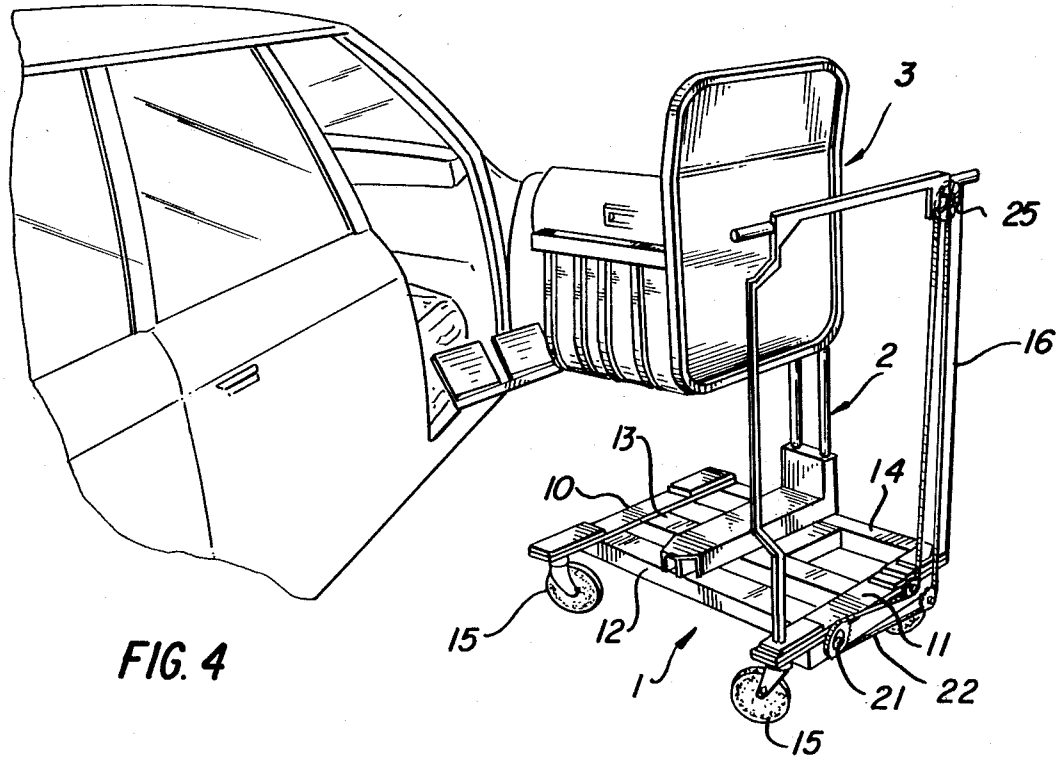
FIG. 4 is a perspective view showing the wheelchair in a position for movement of the chair into an automobile.

In use a handicapped person may be seated in the chair 3 and transported by someone grasping the handle 16 and pushing the chair which may be centrally located over the supporting platform of chassis 1. When it is desired to transfer the person to an automobile, the door of the car is opened and the chair 3 is directed into the door opening as shown in FIG. 4. The footrests are also hinged at their point of attachment to the chair so that they can be raised to clear the car door sills and then relowered to floor level. The chassis 1 is directed towards the door opening at substantially the same angle as the opened door so that the chair 3 is positioned over the car seat angularly. In this position a portion of the supporting platform of the chassis 1 is disposed beneath the car. The operating wheel 25 is then rotated to rotate the arm 26 with respect to the chassis 1. The arm 26 is rotated until the chair 3 is turned so that the chair back is aligned with the car seat back. The crank arm 41 may then be rotated to lower the chair to rest on the car seat. Continued rotation of the crank arm 41 causes the upper support bar 37 to be withdrawn from the recess formed inside housing 9 of support means 7 on chair 3 so as to disengage the chair from the remainder of the wheelchair. The chassis 1 and chair supporting frame 2 may then be separated and folded for storage.

Obviously many modifications and variations of the present invention are possible in light of the foregoing teachings.

What is claimed as new and is desired to be secured by Letters Patent is:

1. A method of transferring a handicapped person from a wheeled chair into an automobile wherein the wheeled chair includes a wheeled chassis, handle means on one end of the chassis, a chair supporting frame, the chair supporting frame including a horizontally extending base member and a vertically extending support post means mounted on one end of the base member, means rotatably mounting the other end of the horizontally extending base member centrally on the chassis, a chair for supporting a handicapped person and means removably mounting the chair in a cantilevered manner on the upper end of the vertically extending support post means in vertical spaced relation to the wheeled chassis, said method comprising the steps of supporting the chair from the side in spaced relation to the wheeled chassis, rolling the wheeled chassis beneath an automobile so as to position the chair over the seat of an automobile, rotating the chair with respect to the wheeled chassis chair into parallel relation with respect to the back of the so as to bring the back of the seat of the automobile, lowering the chair so that it rests on the seat of the automobile and detaching the chair from the wheeled chassis.

2. A method according to claim 1 wherein at least part of the wheeled chassis is disposed under the automobile when the chair is positioned over the seat of an automobile with the sides of the chassis extending substantially parallel to the plane of the opened automobile door.

3. A wheel chair for supporting a handicapped person and for transferring the handicapped person in the chair to an automotive seat comprising a wheeled chassis, handle means on one end of said chassis, said chassis being of a height to permit said chassis to be rolled beneath an automobile, a chair supporting frame, said chair supporting frame including a horizontally extending base member and a vertically extending support post means mounted on one end of said base member, means rotatably mounting the other end of said horizontally extending base member centrally on said chassis, a chair for supporting a handicapped person, means removably mounting said chair in a cantilevered manner on the upper end of said vertically extending support post means in vertical spaced relation to said wheeled chassis and substantially overlying the length of said base member so that when said chassis is rolled beneath an automobile the chair will be positioned over the automobile seat, and means for vertically adjusting the position of said chair with respect to said chassis whereby when the chair is positioned over an automobile seat the chair may be lowered onto the seat and the chassis and chair supporting frame may be disconnected from the chair.

4. A wheel chair according to claim 3 wherein said means for removably mounting said chair includes a horizontally extending support bar and abutment means disposed in vertically displaced relation with respect to said support bar whereby the support bar is adapted to fit within a cavity on the side of the chair and the abutment means is adapted to abut the side of the chair to retain the chair in an operative position.

5. A wheel chair according to claim 3 wherein said means for rotatably mounting said chair supporting frame on said wheeled chassis comprises a worm gear drive, a shaft extending from said worm gear drive, and an operating wheel on said handle means, means connecting the operating wheel with said shaft whereby upon rotation of said operating wheel the chair rotates on said wheeled chassis.

6. A wheel chair according to claim 3 wherein said means for vertically adjusting the position of said chair on said chair support frame comprises a support post and a vertically extending screw disposed parallel to said support post, means for rotating said screw, said means for removably mounting said chair on said support post including an apertured block slidable on said support post, a fixed nut in said apertured block engaged with said screw whereby upon rotation of said screw said block is driven vertically on said support post.

* * * * *